229-1.5 SR
10/22/85 OR 4,548,348

United States Patent [19]

Clements

[11] Patent Number: 4,548,348

[45] Date of Patent: Oct. 22, 1985

[54] DISPOSABLE CUP ASSEMBLY

[75] Inventor: Jack D. Clements, Ada, Okla.

[73] Assignee: Solo Cup Company, Highland Park, Ill.

[21] Appl. No.: 584,112

[22] Filed: Feb. 27, 1984

[51] Int. Cl.[4] ..... B65D 21/02; A47G 19/03; A47G 19/23

[52] U.S. Cl. ..... 229/1.5 H; 220/85 H; 220/410; 215/100.5; 206/519; 206/514

[58] Field of Search ..... 229/1.5 H; 220/410, 220/85 H; 215/12 R, 12 A, 13, 100.5; 206/514, 519, 520

[56] References Cited

U.S. PATENT DOCUMENTS

| | | | |
|---|---|---|---|
| Re. 29,320 | 7/1977 | Kalata et al. . | |
| 2,287,610 | 6/1942 | Guidry . | |
| 2,483,168 | 9/1949 | Amberg . | |
| 2,685,319 | 8/1954 | Swasko | 215/12 A |
| 3,232,512 | 2/1966 | Wanderer . | |
| 3,337,109 | 8/1967 | Shumrak . | |
| 3,409,207 | 11/1968 | Eicholtz et al. . | |
| 3,596,795 | 8/1971 | D'Ercoli . | |
| 3,653,575 | 4/1972 | Schrepper . | |
| 3,760,972 | 9/1973 | McKirnan | 220/410 |
| 3,804,281 | 4/1974 | Eckdahl . | |
| 3,871,543 | 3/1975 | Chadfield et al. . | |
| 3,927,766 | 12/1975 | Day . | |
| 3,978,232 | 8/1976 | Dodsworth et al. . | |
| 3,995,740 | 12/1976 | Amberg et al. . | |
| 4,082,200 | 4/1978 | Guest et al. . | |

*Primary Examiner*—George E. Lowrance
*Attorney, Agent, or Firm*—Fitch, Even, Tabin & Flannery

[57] ABSTRACT

A disposable cup assembly comprising an integral thermoplastic thin-walled liner having a sidewall of truncated substantially right circular conical shape and having a closed bottom wall, for receiving the beverage. The assembly also includes an integral thermoplastic thin-walled holder for receiving the liner with the holder also having a sidewall of substantially truncated right circular conical shape. The liner and holder include releasable interlocking means for retaining a liner in the holder. The sidewall of the liner has a greater angle of convergence with its axis than does the sidewall of the holder, to form a thermally insulative air pocket beneath the level of the interlocking means. Furthermore, the holder is symmetrical about any plane containing its longitudinal axis so that a plurality of the holders substantially fully telescopically nest in a stack.

5 Claims, 4 Drawing Figures

22
20
33
46
38
44
30
24
34

28
34
52
24
33
20
22
30
36
32
26
48
42
40
46

52
50
44
58
54
56

20
22

DISPOSABLE CUP ASSEMBLY

BACKGROUND OF THE INVENTION

The present invention relates to cups and, more particularly, to a cup assembly formed by a disposable liner and a disposable holder for receiving said liner.

It is common practice for office workers to be provided with hot beverages such as coffee, tea and hot chocolate. A low cost and highly sanitary method of distributing such beverages is to offer a limited number of reusable holders for using disposable plastic liners. Examples of such liners and holders are shown and described in commonly assigned U.S. Pat. No. 3,596,795. While such a system typically works well, problems can arise. For example, some of the holders may be lost or a worker might accumulate a number of holders at his or her work station thus depleting the number of holders available for use by others. If the holders are all out, a person desiring a drink would be left with only the liners which would become too hot to comfortably handle. Additionally, liners typically have a bottom wall which is of small diameter and/or is not flat so that they are somewhat unstable when set down which might promote spilling of the liquid. After repeated use, the holders may become soiled and require washing.

SUMMARY OF THE INVENTION

Among the several objects of the present invention may be noted the provision of an improved cup assembly wherein both the holder and liner are disposable; the provision of such cup assembly which forms an air pocket surrounding a substantial portion of the liner to prevent rapid temperature change of the beverage; the provision of such cup assembly which is substantially full telescopic nesting of the holders as well as the liners to reduce storage space requirements; and the provision of such cup assembly which is formed by components which are inexpensive and relatively easy to manufacture. Other objects and features of the present invention will be in part apparent and in part pointed out hereinafter in the following specification and attendant claims.

Briefly, the disposable cup assembly of the present invention includes a liner and a holder, each being of integral thermoplastic thin-walled construction and of truncated substantially right circular conical shape. The liner and holder have releasable interlocking means for retaining a liner in the holder with the holder having its interlocking component adjacent its top. The sidewall of the liner has a greater angle of convergence with its axis than does the sidewall of the holder to form a thermally insulative air pocket beneath the level of the interlocking means. The holder is substantially symmetrical about any plane containing its longitudinal axis to enable a plurality of the holder to telescopically nest in a stack.

BRIEF DESCRIPTION OF THE DRAWINGS

Corresponding reference characters indicate corresponding components throughout the several views of the drawings.

DESCRIPTION OF THE PREFERRED EMBODIMENT

Figures 1, 2, 3, 4:
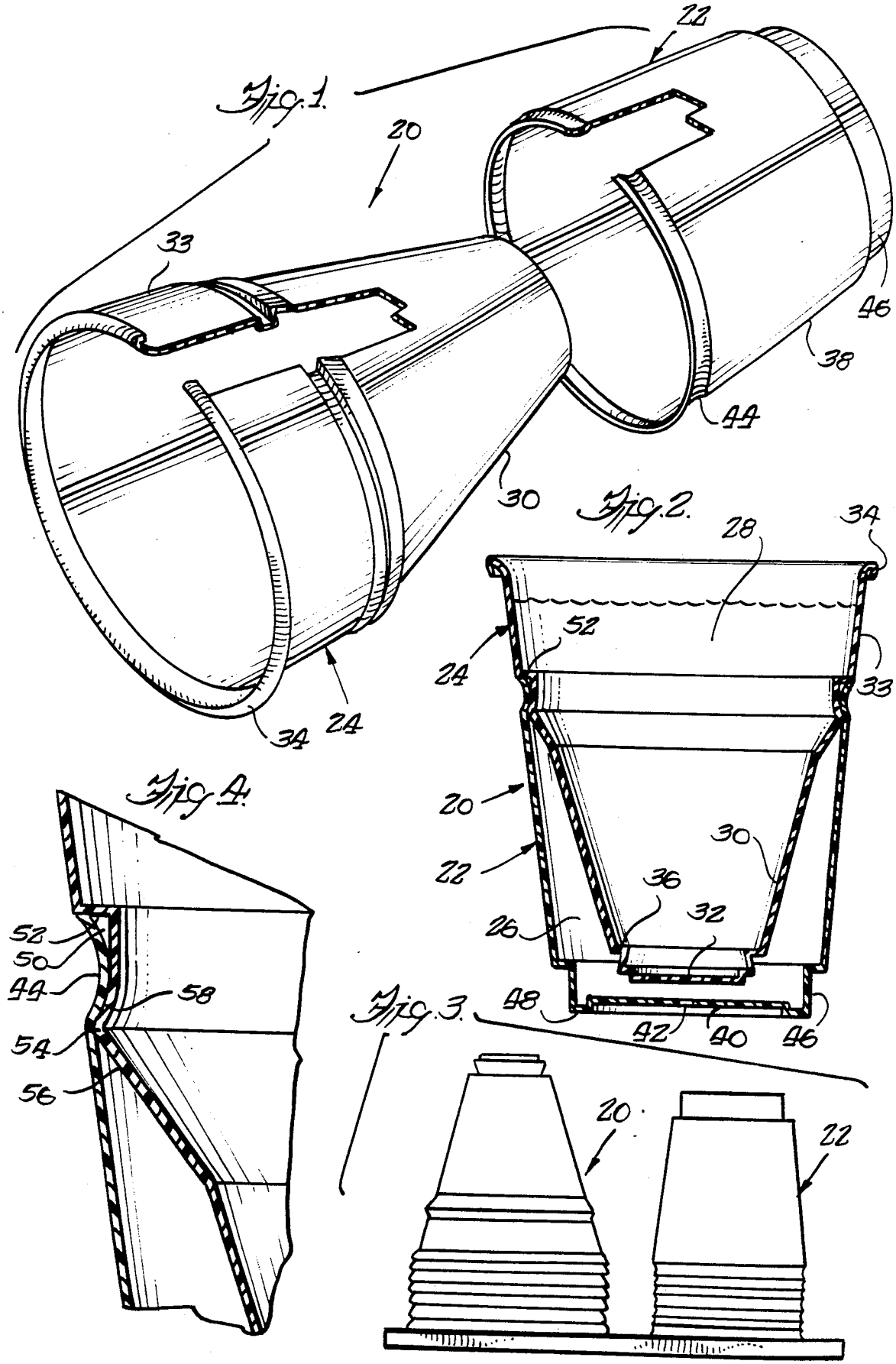
FIG. 1 is a perspective view of an aligned liner and holder which together form the cup assembly of the present invention.
FIG. 2 is a longitudinal sectional view of the cup assembly of FIG. 1.
FIG. 3 is a front elevational view of a base upon which is loaded a stack of nested liners and an adjacent stack of nested holders.
FIG. 4 is an enlarged fragmentary sectional view showing interlocking components of the liner and holder.

Referring now to the drawings, the cup assembly of the present invention is generally indicated in FIGS. 1 and 2 by reference character 20. The cup assembly includes a disposable holder 22 for receiving a disposable liner 24 and is particularly useful in the distribution of hot beverages such as coffee, tea and hot chocolate. When mated, the components define a thermally insulative air pocket 26 fully surrounding the lower portion of the liner to prevent rapid cooling of the contained beverage 28. The assembly is also useful with cold beverages. The air pocket again prevents rapid temperature change in the liquid. Since the holder does not become cold, it does not sweat as is common for non-insulated cold beverage containers used in warm, humid environments. The cup assembly also can be used for holding other consumables such as ice cream or flavored ice. As shown in FIG. 3, both the holders and liners are substantially fully telescopically nestable for convenient storage, and so a large number of each can be positioned for ready accessibility at the beverage preparation location.

The liner 24 is of integral thermoplastic thin-walled construction and has a sidewall 30 of truncated right circular conical shape and a closed bottom wall 32 with the sidewall having an extension 33 forming an open top with a smooth curled upper lip 34. Adjacent the bottom wall, the sidewall has a reversely tapered portion forming a pedestral rib 36 of smaller inside diameter than the outside diameter of the bottom wall so that when the liners are nested, the sidewalls of adjacent liners are held out of full surface engagement to promote separation of the stacked liners.

The holder 22 is also of integral thermoplastic thin-walled construction and has a sidewall 38 in the general shape of a right circular cone and a bottom wall 40 which is substantially closed except it preferably is provided with a small aperture 42 for relieving pressure as the liner and holder are brought together in a tight fit. The holder has an interlocking component in the form of an annular inner rib 44 disposed at the top of the sidewall 38. The sidewall has a base portion 46 of smaller diameter than the remainder of the sidewall, while the bottom wall has a peripheral rib 48 extending outwardly in the longitudinal direction of the holder for maintaining the central portion of the bottom wall out of engagement with the surface upon which the cup assembly is set. The holder does not require a handle (due to the presence of the air pocket, the holder remains cool) and the holder is substantially symmetrical about any plane containing its longitudinal axis.

The liner also includes an interlocking component for cooperating with holder rib 44 to releasably maintain the liner and holder united. Between sidewall 30 and extension 33, the liner has a groove 50 for receiving rib 44. The groove is defined by an upper abutment surface 52 for limiting insertion of the liner, and a lower rib 54. The lower rib is formed by a lower cam surface 56 for engagement by the holder rib upon incipient mating, and an upper cam surface 58, facing the abutment surface, for permitting separation of the components.

The angle of convergence of the holder sidewall with the holder axis is somewhat less than that of the liner sidewall with the liner axis. Additionally, the extent of the holder sidewall beneath its interlocking component is somewhat greater than that of the liner. Thus, with the cup assembly components mated, the lower portion of the liner is held fully encompassed by the air pocket to slow cooling of the hot beverage.

Both the liner and holder may be shaped from sheets of extruded plastic material using a vacuum forming process. Such processes are well-known to those of skill in the art and need not be further discussed here. A suitable plastic material is polystyrene, but other suitable plastic materials may also be used. The liner and holder are of thin-walled construction with the sidewall of the liner having a generally uniform thickness and within the range of 0.006 and 0.025 inch with a 0.015 inch wall thickness being preferred. The holder has a sidewall slightly thicker than that of the liner. While the holder is still of thin-wall construction, it has greater sustainability than the liner. When the two are mated, the liner reinforces the holder to give the combination still greater strength and rigidity.

Operation of the cup assembly of the present invention relative to its use as a hot beverage container, is as follows: Inverted stacks of the liners and holders may be provided at the beverage preparation station as shown in FIG. 3. The user mates the components by simply lifting a holder from its stack and pushing it onto the stack of liners. When the holder rib 44 engages the liner cam surface 56, the continued application of force results in mutual deformation of the sidewalls, with the holder sidewall expanding slightly and the liner sidewall contracting slightly to allow the holder rib to move past the liner rib 54 into groove 50 and against abutment surface 52. As the groove receives rib 44 in a tight fit forming a seal which inhibits the passage of air, pressure tends to increase in the pocket 26, but this pressure is vented by aperture 42. The user can lift the completed cup assembly from the stack of liners, set it right side up, and fill it with the hot beverage.

While the air in pocket 26 is held static to reduce heat loss of the liquid in the lower portion of the liner due to thermal conduction and convection, the liquid in the liner above the level of the holder is allowed to cool more quickly to a temperature suitable for drinking. Also the extension 33 of the liner sidewall above the holder permits convenient separation of the components should the user desire to replace the liner. By simply grasping the holder and pulling outwardly on the extension, upper liner cam surface 58 is brought to bear on holder rib 44 resulting in mutual deformation of the respective sidewalls effecting release of the liner.

Thus, it will be appreciated that the cup assembly of the present invention has greater resistance to beverage heat loss than prior art cup assemblies. Cup assembly 20 is highly sanitary and convenient to use. Furthermore, since it is expected that the holder will be thrown away, the supplier will more likely have a suitable supply of holders available. With prior art reusable holders of thick wall construction, only a limited number would typically be supplied, and that number could be quickly depleted due to loss or failure to return.

In view of the above, it will be seen that the several objects of the invention are achieved and other advantageous results attained.

As various changes could be made in the above description without departing from the scope of the invention, it is intended that all matter contained in the above description shall be interpreted as illustrative and not in a limiting sense.

What is claimed is:

1. A disposable cup assembly comprising:

an integral vacuum formed thermoplastic thin-walled liner having a sidewall of truncated substantially right circular conical shape and having a closed bottom wall, and an integral vacuum formed thermoplastic thin-walled holder for receiving said liner said holder also having a sidewall of substantially truncated substantially right circular conical shape, said liner and said holder each comprising an interlocking component together constituting releasable interlocking means for retaining a liner in said holder, the sidewall of said liner having a greater angle of convergence with its axis than does the sidewall of said holder, to form a thermally insulative air pocket beneath the level of said interlocking means, the horizontal spacing between the liner sidewall and the holder sidewall increasing with distance beneath the level of said interlocking means through substantially the entire coextension of said liner and said holder so that the rate of heat transfer between said liner and said holder is generally reduced with distance beneath said interlocking means, said horizontal spacing being significantly greater than the thickness of the holder wall throughout substantially the entire coextension of said liner and said holder, said holder terminating at the level of said interlocking means and said liner extending thereabove so that said liner and said holder can be easily separated;

said holder has a substantially closed bottom wall and wherein said holder bottom wall is spaced from that of said liner whereby said air pocket surrounds the entire outside surface of said liner beneath the level of said interlocking means, when said holder and said liner are mated, the portion of said liner beneath the level of said interlocking components hangs pendent, fully encompassed by said air pocket and out of contact with said holder, said holder being substantially symmetrical about any plane containing its axis so that a plurality of said holders substantially fully telescopically nest to form a stack.

2. An assembly as set forth in claim 1 wherein said interlocking means forms a seal inhibiting the passage of air, said holder bottom wall having an aperture for relieving pressurization upon incipient holder/liner mating.

3. An assembly as set forth in claim 1 wherein said interlocking means comprises an inner rib formed at the top of the holder which terminates in an upper end, and a groove formed on the outer surface of the sidewall of said liner for seating said rib.

4. An assembly as set forth in claim 3 wherein said groove is defined by an upper abutment surface engaging said holder upper end for preventing further insertion of said liner, and a lower rib.

5. An assembly as set forth in claim 4 wherein said lower rib comprises an upper cam surface facing said abutment surface and a lower cam surface for engagement by the holder rib upon incipient mating, said upper cam surface permitting separation of the components, albeit with some difficulty.

* * * * *